US010041740B2

(12) United States Patent
Takase

(10) Patent No.: US 10,041,740 B2
(45) Date of Patent: Aug. 7, 2018

(54) HEAT EXCHANGER AND PRODUCTION METHOD THEREFOR

(71) Applicant: T.RAD Co., Ltd., Tokyo (JP)

(72) Inventor: Masaaki Takase, Tokyo (JP)

(73) Assignee: T.RAD Co., Ltd., Tokyo (JP)

( * ) Notice: Subject to any disclaimer, the term of this patent is extended or adjusted under 35 U.S.C. 154(b) by 0 days.

(21) Appl. No.: 15/577,144

(22) PCT Filed: May 25, 2016

(86) PCT No.: PCT/JP2016/066319

§ 371 (c)(1),
(2) Date: Nov. 27, 2017

(87) PCT Pub. No.: WO2016/190445

PCT Pub. Date: Dec. 1, 2016

(65) Prior Publication Data

US 2018/0172355 A1 Jun. 21, 2018

(30) Foreign Application Priority Data

May 27, 2015 (JP) ..... 2015-107675

(51) Int. Cl.

| | |
|---|---|
| ***F28F 9/02*** | (2006.01) |
| ***F28D 1/053*** | (2006.01) |
| ***F28F 9/26*** | (2006.01) |
| ***F28F 27/02*** | (2006.01) |
| ***F28F 9/18*** | (2006.01) |

(52) U.S. Cl.

CPC ..... *F28D 1/05383* (2013.01); *F28F 9/0243* (2013.01); *F28F 9/0246* (2013.01); *F28F 9/18* (2013.01); *F28D 1/05391* (2013.01); *F28F 9/027* (2013.01); *F28F 9/0239* (2013.01)

(58) Field of Classification Search

CPC ..... F28D 1/05383; F28D 1/05391; F28F 9/0243; F28F 9/0246; F28F 9/0239; F28F 9/027

USPC ..... 165/144, 153, 173, 175

See application file for complete search history.

(56) References Cited

U.S. PATENT DOCUMENTS

| | | | | |
|---|---|---|---|---|
| 3,774,678 A * | 11/1973 | Glorisi | ..... | B60K 11/02 137/510 |
| 4,191,244 A | 3/1980 | Keske | | |
| 6,883,596 B2 * | 4/2005 | Kim | ..... | F25B 39/04 159/13.3 |
| 2016/0084548 A1 | 3/2016 | Ota et al. | | |

FOREIGN PATENT DOCUMENTS

| | | | |
|---|---|---|---|
| JP | 55-500061 | A | 2/1980 |
| JP | 2003-075092 | A | 3/2003 |
| WO | 2014/181550 | A1 | 11/2014 |

* cited by examiner

*Primary Examiner* — Jianying Atkisson
*Assistant Examiner* — Joel Attey
(74) *Attorney, Agent, or Firm* — Norris McLaughlin & Marcus, P.A.

(57) ABSTRACT

A heat exchanger is formed by a plurality of heat exchanger units each including a respective small tank at each end of a core, the units being stacked in a thickness direction of the cores, and oil is supplied to finned tubes constituting the core of each of the units via a header. Each of the tanks has an opening for communicating with the header which opening is at a position on the length of the tank different from that of each of the adjacent tanks.

5 Claims, 6 Drawing Sheets

HEAT EXCHANGER AND PRODUCTION METHOD THEREFOR

TECHNICAL FIELD

The present invention relates to a heat exchanger and production method therefor to overall improve performance of heat exchange in a heat exchanger formed of a plurality of heat exchanger units placed in parallel in a thickness direction.

BACKGROUND ART

Japanese Patent Laid Open No. 2003-75092 described below describes a unit-assembly-type heat exchanger. Fins and tubes are alternately placed in parallel to form a core. At an upper portion and a lower portion of the core, a pair of tanks are arranged, and a flow-in opening for a heat exchange medium is provided at a center of each tank.

FIG. 6 is an exploded perspective view illustrating the unit-assembly-type heat exchanger according to the Japanese Patent Laid Open No. 2003-75092. Both ends of a tube 2 are each inserted and fixed into a pair of small tanks 4 arranged at the upper portion and the lower portion, and a connection bracket 13 is arranged at a center of the small tank 4 in a longitudinal direction. Each of the connection brackets 13 is fastened with each other via an O-ring 15 and a bolt 17 to be integrated. Then, as the heat exchange medium, oil is supplied from a pipe 16 provided for the connection bracket 13 in the front row, and the oil is supplied into each tube 2 of each of units.

Next, the inventor of the present invention has already applied an oil cooler of high resistance to pressure for construction machines; Japanese Patent Application No. 2014-009616. According to that invention, a pair of cores are placed in parallel in the thickness direction thereof. In addition, flat tubes of each of the cores are inserted into a tank main body in a U-shape groove, an opening portion of the flat tube is closed with a cap member, and further both end portions thereof are closed with an end cap. Then, an opening portion is formed at a center of each tank in a longitudinal direction to bond the opening portion of the tank with that of the header by welding.

SUMMARY OF INVENTION

Technical Problem

According to the invention described in Japanese Patent Laid Open No. 2003-75092, an inlet of the heat exchange medium exists at a center position of a small tank 4 of each of the units, and oil is supplied into each of the tubes from the inlet. Then, more oil flows into the tube placed at a position closer to an opening of the small tank 4, and flow speed of the oil in the tube near the opening is faster than the tube farther from the opening. Therefore, imbalance of flow speed density of the oil is caused in the flat tubes of each of units.

On an outer circumference of the each flat tube, an air flow for cooling is circulated. At this time, if the air is supplied to a portion where the flow speed of the oil is fast, the heat is exchanged the most, and thus the temperature of cooling air becomes high. The cooling air at high temperature is supplied to a position where the flow speed of the oil is fast in the unit placed at a downstream side of the air. Therefore, between an amount of exchanged heat at a center portion of the core and an amount thereof at both end portions of the core, variation is caused to deteriorate heat exchange efficiency overall.

Accordingly, it is an object of the present invention to increase the amount of the heat exchange overall by comprehensively making the heat exchange in each portion of the each unit uniform. In addition, the object is to distribute the heat exchange medium in the small tank 4 of each of the units via a header tank to facilitate connection between the units.

Solution to Problem

The present invention according to a first aspect is a heat exchanger in which each of fins 1 and each of tubes 2 are alternately placed in parallel to form a core 3, small tanks 4 are arranged at both ends of the core 3 so that both ends of each of the tubes 2 are inserted to structure a unit 5, the plurality of units 5 in a same shape is stacked in parallel in a thickness direction of the unit 5, a heat exchange medium is supplied to each of the tubes 2 of each of the cores 3 via each of the small tanks 4, and an air flow is led in such a manner to cross a flat surface of each of the cores 3, wherein each of the small tanks 4 and a header tank 8 connecting to each of the small tanks 4 are configured from a pipe member, each of the small tanks 4 is formed with an opening 7 at a position on an opposite side of the core 3, an opening 7 of a first small tank 4 and an opening 7 of a second small tank 4 that are adjacent to each other are arranged at different positions in a longitudinal direction of each of the small tanks 4, and a plurality of connection openings 9 is formed in the header tank 8 to match each of the openings 7, and each of the connection openings 9 of the header tank, i.e., header, 8 and the opening 7 of each of the small tanks 4 are connected with each other via a short, i.e., connection, pipe 6.

The present invention according to a second aspect is the heat exchanger according to the first aspect, wherein two or more of the units 5 are placed in parallel, and the openings 7 of each of the small tanks 4 of the units 5 that are adjacent to each other are arranged in a different manner in a longitudinal direction of each of the small tanks 4.

The present invention according to a third aspect is the heat exchanger according to the second aspect, wherein, on a straight line obliquely crossing an axial line of each of the small tanks 4, the openings 7 of each of the small tanks 4 are arranged and the connection holes 9 matching each of the openings 7 are provided in an outer surface of the header tank 8, lying on a straight line parallel to an axial line.

The present invention according to a fourth aspect is the heat exchanger according to the second aspect, wherein each of the openings 7 of each of the small tanks 4 is arranged in a zigzag manner in a plan view.

The present invention according to a fifth aspect is a production method for a heat exchanger according to any of the first to fourth aspects comprising the steps of:

producing each of units 5 by brazing each of cores 3 with a small tank 4; and connecting an opening 7 of the small tank 4 of each of the units 5 with each of the connection openings 9 of a header tank 8 via a short pipe 6 by welding.

The present invention according to a sixth aspect is the production method for a heat exchanger according to the fifth aspect comprising the steps of:

structuring the header tank 8 with a tank main body 8*a* and a top cap 8*b* each having a half-split shape, and forming a plurality of the connection openings 9 in the tank main body 8*a;* welding and fixing the connection opening 9 of the tank main body 8*a* with the opening 7 of each of the small tanks 4 via the short pipe 6; and welding between the tank main body 8*a* and the top cap 8*b*.

Advantageous Effects of Invention

According to the present invention, an opening 7 of a first small tank 4 and an opening 7 of a second small tank 4 that are adjacent to each other are arranged at different positions in a longitudinal direction of the small tanks. In addition, a plurality of connection openings 9 is formed in a header tank 8 so as to match each of the openings 7, and each of the connection openings 9 of the header tank 8 is connected with the opening 7 of each of the small tanks 4 via a short pipe 6.

Therefore, the small tanks 4 of the units 5 have different inlets and outlets, respectively, and accordingly flow speed distributions of the heat exchange medium that flows in the respective tubes 2 of the respective units 5 are different. That is, the flow speed of the heat exchange medium in the respective tubes 2 near the outlet and inlet of the small tank 4 becomes faster, and the farther from the outlet and inlet of the small tank 4 the tube is, the lower the flow speed becomes.

However, since the flow speed distributions in the respective tube 2 of the respective unit 5 are different between an upstream side and a downstream side, the air flow that has passed through a position where the flow speed of the heat exchange medium is fast in the first unit 5 and thus has higher temperature passes a position where the flow speed thereof is low in the second unit 5 that is adjacent to the first unit 5, so as to make uniform the amount of the heat exchange of the each portion in their entirety, thereby obtaining the heat exchanger having high performance.

Further, according to a production method for the heat exchanger of the present invention, in the above described heat exchanger, each of the cores 3 and the small tank 4 are brazed with each other, and the opening 7 of the small tank 4 of each of the units 5 and each of the connection openings 9 of the header tank are connected with each other via the short pipe 6 by welding. Then, since the opening 7 of the first small tank 4 and the opening 7 of the second small tank 4 that are adjacent to each other are arranged at the different positions in the longitudinal direction of the small tanks, space between the short pipes 6 that are adjacent to each other is widened, so that, when welding, the both ends of the each short pipe can be easily welded without interfering each other.

As the fifth aspect of the invention, when the header tank 8 includes a tank main body 8*a* and a top cap 8*b* each having a half-split shape, the heat exchanger tank structure can be produced further easily.

DESCRIPTION OF EMBODIMENTS (Structure of Example 1)

Next, with reference to figures, embodiments of the present invention will be described.

Figure 1:
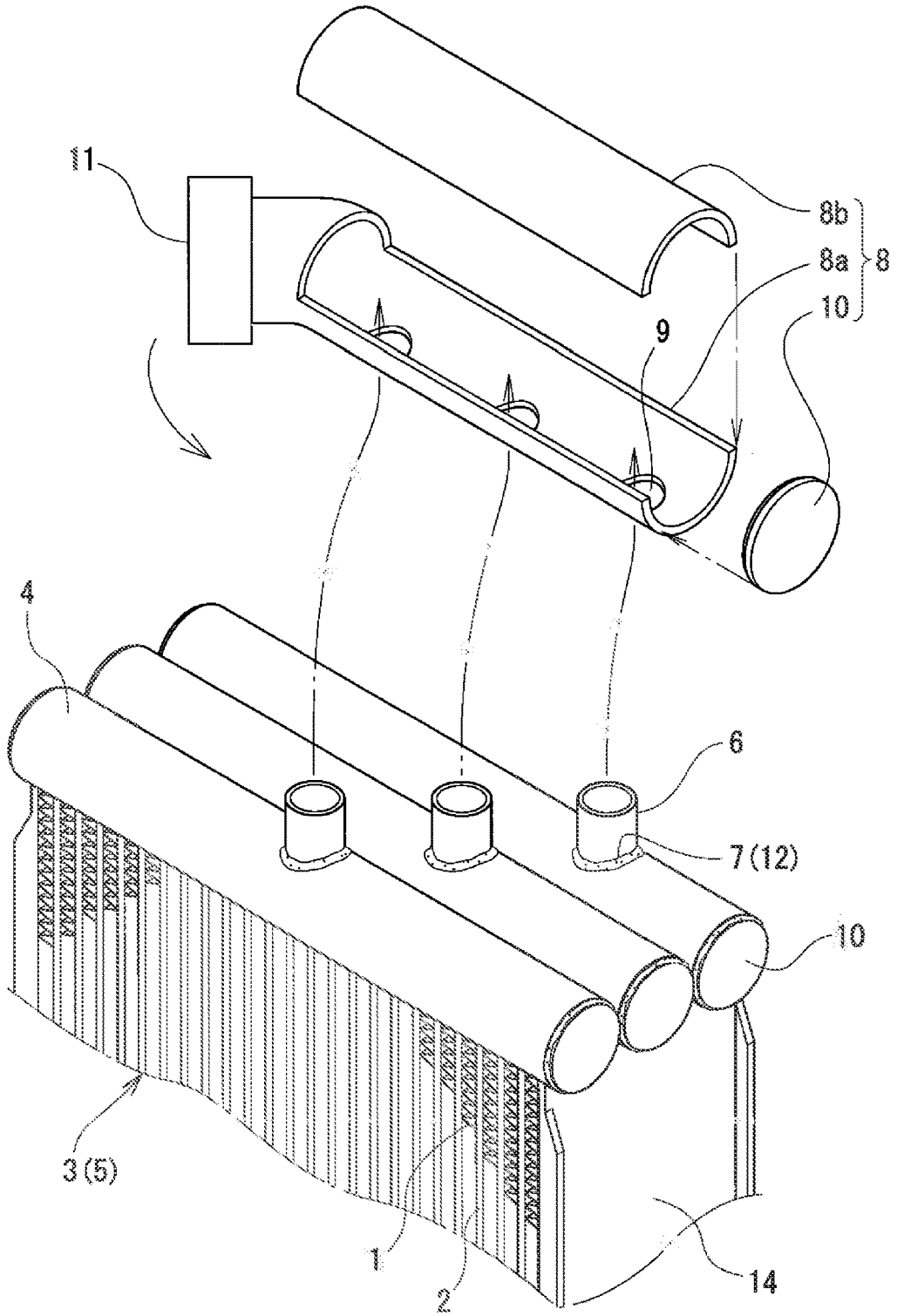
FIG. 1 is an exploded perspective view of a tank structure of the present invention.
Figure 2:
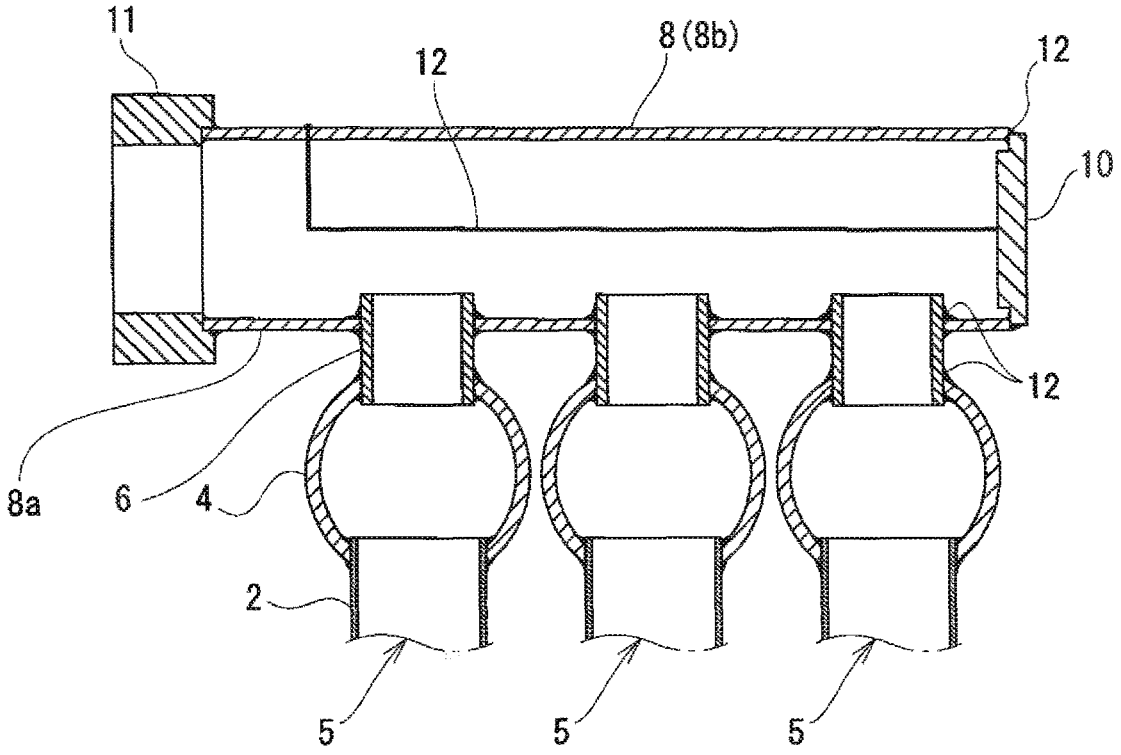
FIG. 2 is a vertical cross sectional view illustrating an assembly state of the tank structure of the present invention, and an arrow view along II-II in FIG. 3.
Figure 3:
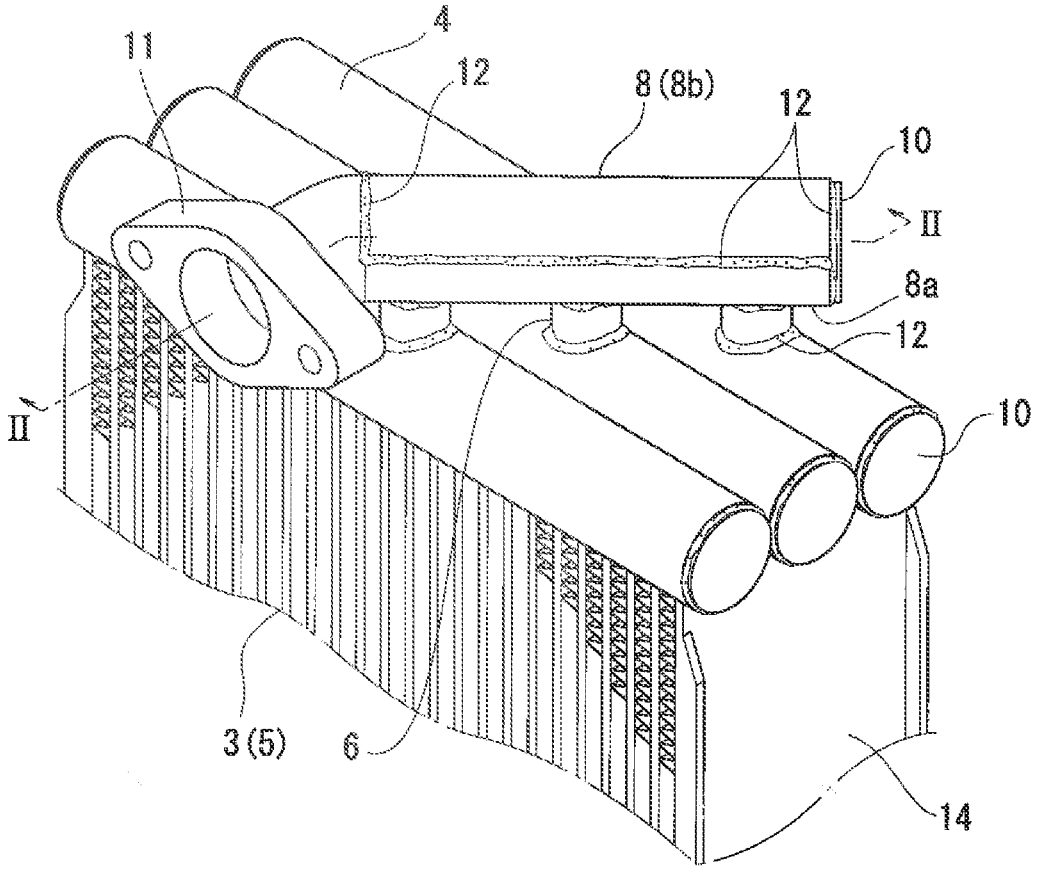
FIG. 3 is a perspective view illustrating the assembly state of the tank structure of the present invention.

FIGS. 1 to 3 illustrate Example 1 of the present invention, FIG. 1 is an exploded perspective view of essential portions, FIG. 2 is a vertical cross sectional view of the essential portions illustrating an assembly state, and FIG. 3 is a perspective view of the essential portions. In these figures, only upper portion of each tank structure is illustrated. The tank structure of the lower portion that is not illustrated preferably has the same structure as that of the upper portion.

In this Example, three units 5 having the same shape are stacked in a thickness direction of a core 3. The number of the units 5 may be two or four or more. In the each unit 5, fins 1 and tubes 2 are alternately placed in parallel to form the core 3. At both an upper end and a lower end, a pair of small tanks 4 are arranged. Then, both ends of the each tube 2 are inserted into the small tank 4. In this example, the small tank 4 includes a pipe member, and an end cap 10 arranged at both ends of the small tank 4.

Further, a number of flat tube insertion holes are drilled in the pipe member, and the flat tubes 2 are inserted into the tube insertion holes. In addition, at both ends of the each small tank 4 in a longitudinal direction, a slit (not illustrated) into which an end portion of a side member 14 is inserted is formed.

Furthermore, with a state where the end portions of the pair of side members 14 are inserted into the respective small tanks 4, respective parts are brazed and fixed integrally. Note that, in this example, the pair of side members 14 are inserted into three small tanks 4, but in place of the method, each independent side member 14 may be arranged at the both ends of the each core 3.

An assembled body of each of the cores 3 with the side member 14 structured in this way is conveyed into a furnace at high temperature, to be brazed and fixed integrally. Note that, in the small tank 4, the opening 7 is formed in advance. As illustrated in FIGS. 1 and 3, the openings 7 of the small tanks 4 of the respective units 5 that are adjacent to each other are arranged at the different positions in the axial line direction. In this example, the openings 7 are arranged on one straight line that is inclined relative to the respective small tanks 4.

Next, one end of a short pipe 6 is inserted into the each opening 7, and welding is performed between the short pipe 6 and the opening 7 of the small tank 4 to form a welding portion 12. Then, another end of the each short pipe 6 is welded to a connection opening 9 of the header tank 8.

In this example, the header tank 8 includes a flange 11 at its one end and an end cap 10 at another end. Further, the header tank 8 includes a tank main body 8*a* and a top cap 8*b* each having a half-split shape of the pipe member, being split on a line of a diameter of the pipe member, and the connection opening 9 is drilled in the tank main body 8*a*. A position of the connection opening 9 matches a position of the each opening 7 of the short pipe 6.

Then, after each of the short pipes 6 is welded to the connection opening 9 of the tank main body 8*a*, the top cap 8*b* is fitted into the opening of the tank main body 8*a* to fit the end cap 10 into the end portion of the tank main body 8*a*. Further, the welding portion 12 is formed on each seam by welding to complete a heat exchanger.

In this example, the header tank 8 includes a combined body of a straight-line pipe member and a curved pipe member. The straight-line pipe member is welded to an end portion of the curved pipe.

In some direction of piping, the curved pipe member can be omitted.

(Structure According to Example 2 of the Present Invention)

Figure 4:
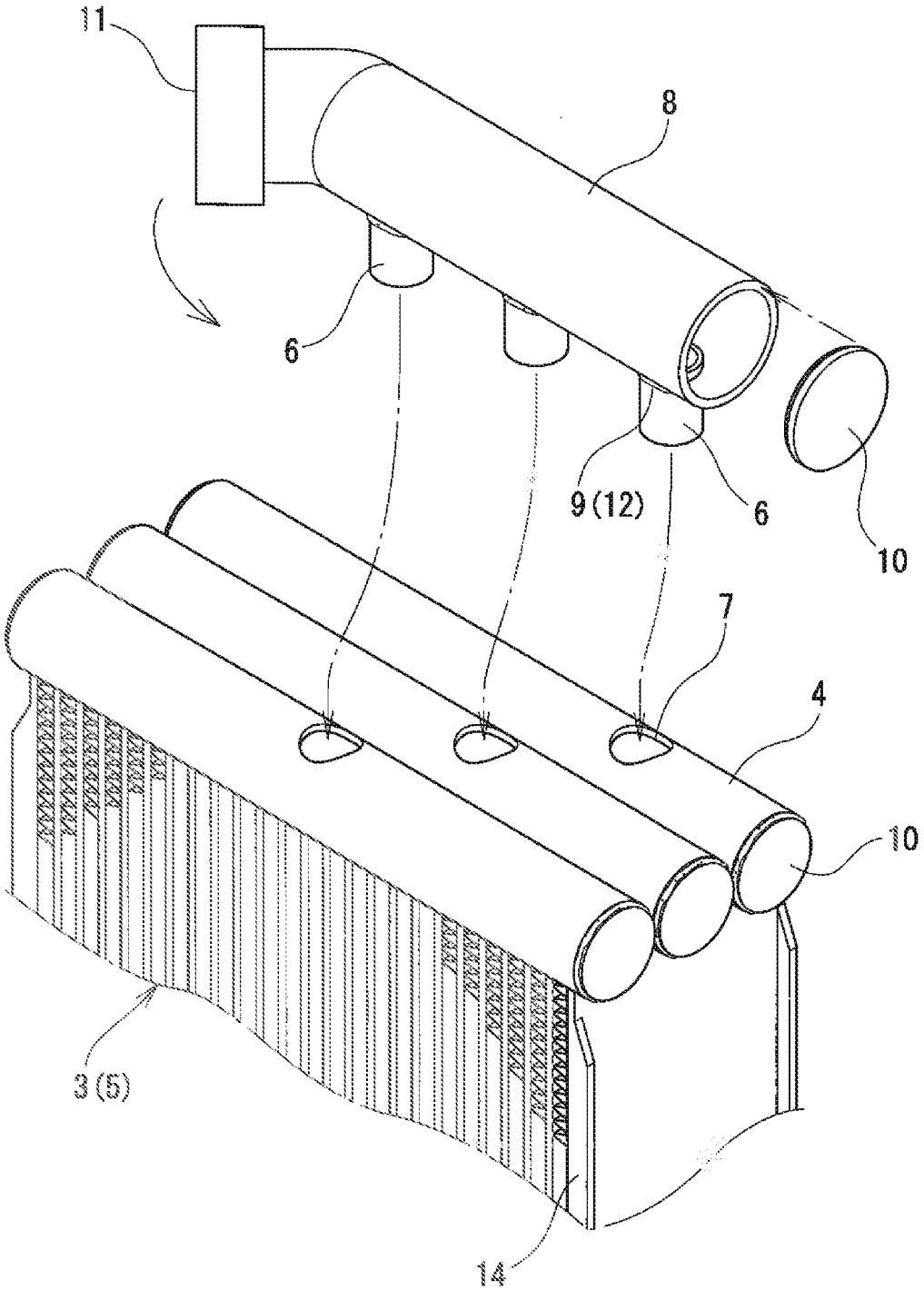
FIG. 4 is an exploded perspective view of a heat exchanger tank structure according to Example 2 of the present invention.

Next, FIG. 4 illustrates Example 2 of the present invention. In this example, the short pipe 6 is welded to the each connection opening 9 of the header tank 8 in advance, and subsequently the opening 7 of the small tank 4 and the each short pipe 6 are welded with each other. Note that welding in an inverse order may also be performed.

(Structure According to Example 3 of the Present Invention)

Figure 5:
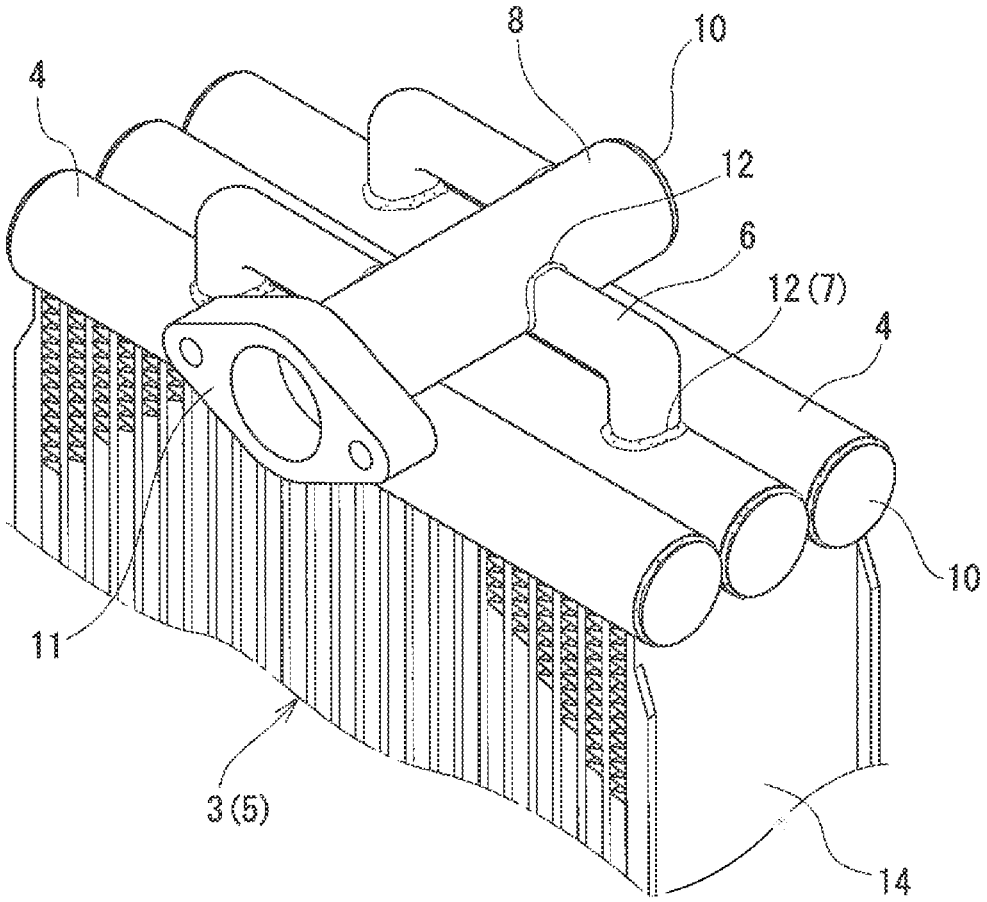
FIG. 5 is a perspective view of a heat exchanger tank structure according to Example 3 of the present invention.
Figure 6:
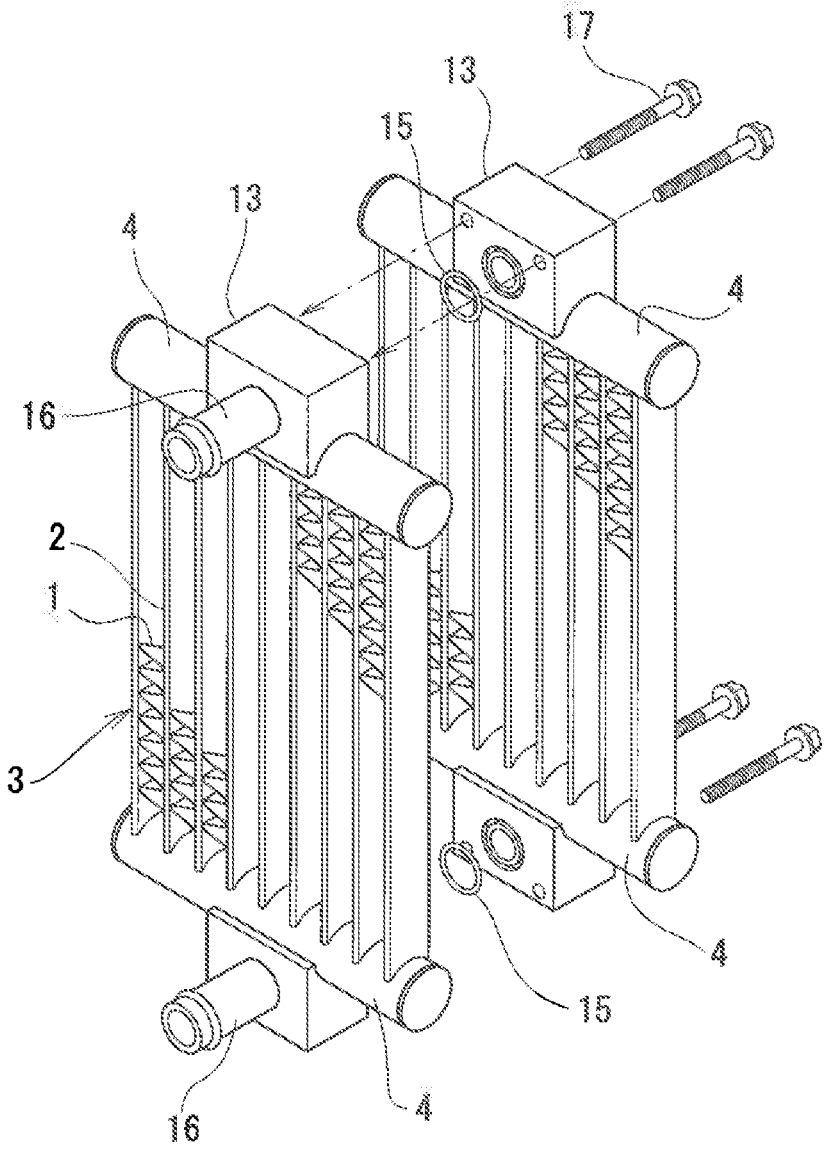
Fig.6 PRIOR ART
FIG. 6 is a perspective view of a tank structure of a conventional type.

Next, FIG. 5 illustrates Example 3 of the present invention. In this example, the openings 7 of the respective small tanks 4 are arranged in a zigzag shape in a plan view. Then, via the short pipe 6 in an elbow shape connected to the header tank 8, the respective connection openings 9 of the header tank 8 and the openings 7 of the respective small tanks 4 are welded to be connected to each other.

The point common to each Example is that the respective openings 7 of the small tanks 4 that are adjacent to each other are arranged at the different positions in the axial line direction of the small tank 4. Note that the opening 7 is opened on an opposite side of the core 3 also in the each small tank 4. As described above, the openings 7 of the small tanks 4 that are adjacent to each other are placed differently in the axial line direction. Therefore, when the short pipe 6 and the small tank 4 are welded, since the short pipe 6 and the small tank 4 are separated away from each other, the short pipe 6 can be welded without being disturbed by the adjacent short pipe 6.

(Operation)

In these Examples, oil at high temperature flows into the tube 2 of the each unit 5 via the header tank 8, and the air flow flows in a direction orthogonal to a plane surface of the each core 3. Then, the heat exchange is performed between the air and the oil.

At this time, the flow speed of the oil in the each tube 2 becomes faster at positions closer to the opening 7, and the flow speed becomes relatively slower at positions farther away from the opening 7. The amount of the heat exchange between the cooling air that has passed through the tube near the opening 7 and the oil becomes larger than that at other positions.

Then, the opening 7 of the small tank 4 of the unit 5 positioned on the downstream side is shifted in the axial line direction with respect to the opening 7 of the small tank 4 of the unit 5 positioned on the upstream side of the cooling air. Therefore, on the downstream side, the cooling air at higher temperature passes through the tube 2 in which the flow speed is slow.

Further, the air flow at comparatively low temperature that has passed through the tube 2 in which the flow speed of the oil is slow and the small tube in which the amount of the heat exchange of the air flow is small, on the upstream side, passes through the tube 2 in which the flow speed is fast, on the downstream side.

Therefore, the final air flow that has passed through the plurality of units 5 has substantially the same temperature in each portion, thereby increasing the overall amount of the heat exchange.

INDUSTRIAL APPLICABILITY

With the heat exchanger of the above-described Examples, the oil cooler has been described, but the present invention is not limited thereto, and can be also used for a radiator for cooling engine cooling water or an intercooler.

REFERENCE SIGNS LIST

1 fin
2 tube
3 core
4 small tank
5 unit
6 short pipe
7 opening
8 header tank
8*a* tank main body
8*b* top cap
9 connection opening
10 end cap
11 flange
12 welding portion
13 connection bracket
14 side member
15 O-ring
16 pipe
17 bolt

The invention claimed is:

1. A heat exchanger comprising an assembly of a plurality of same-shaped heat exchanger units, each of the heat exchanger units comprising a heat exchanger core and a pair of tanks, wherein each of the heat exchanger cores comprises a plurality of tubes having fins, the tubes being arrayed in parallel, a respective one of the pair of tanks is arranged at each respective end of the heat exchanger core of the heat exchanger unit at a respective end of the arrayed tubes and operatively connected to the heat exchanger core for flow of fluid between the tank and the heat exchanger core, the plurality of units is stacked in a thickness direction of the units, which direction is orthogonal to the arrays of the tubes, the heat exchanger is configured for supplying a heat exchange medium to each of the tubes of each of the heat exchanger cores via one of each of the pair of tanks, and for an airflow to be conducted across a plane of each of the heat exchanger cores, at each end of the stacked units a respective header is provided for connection to each of the tanks at that end for flow of fluid between the header and the tanks at that end, each of the tanks and the headers is configured from a respective pipe member, each of the tanks of each of the units has an opening facing away from the core of that unit, each of the tanks of each of the units has a length at right angles to a length of the tubes of that unit and the opening in each tank is at a position on the length of that tank different from that of each adjacent one of the tanks, the respective header for each of the pair of tanks of the stacked units has a plurality of connection openings configured to match the respective tank openings of the stacked units, and each pair of the matched openings are connected with each other via a respective connection pipe.

2. The heat exchanger according to claim 1, wherein the openings of each of the tanks are arranged on a straight line obliquely crossing an axial line of each of the tanks and the tank openings matching each of the header openings are on a straight line parallel to the lengthwise axis of the header.

3. The heat exchanger according to claim 1, wherein the openings of the tanks are arranged in a zigzag manner in a plan view.

4. A production method for a heat exchanger according to claim 1 comprising:

producing each of the units by brazing the core for that unit with the two tanks for that unit and stacking the plurality of the units in the thickness direction; and connecting each of the openings of each of the tanks at each of the ends of the stacked units with each of the connection openings of a respective one of the headers via respective ones of the connection pipes by welding.

5. The production method for a heat exchanger according to claim 4 further comprising:

structuring each of the headers with a main body and a top cap which are so configured that together they form a respective one of the headers, and forming the header connection openings in the header main body;

and for each of the headers welding together the header main body and the top cap after the connecting of each of the openings of the tanks at each of the ends of the stacked units with each of the connection openings of the header main body via the connection pipes.

* * * * *